US011738224B2

(12) United States Patent
Johnson et al.

(10) Patent No.: US 11,738,224 B2
(45) **Date of Patent: *Aug. 29, 2023**

(54) FIRE PROTECTION SYSTEM FOR AN ENCLOSURE AND METHOD OF FIRE PROTECTION FOR AN ENCLOSURE

(71) Applicant: Carrier Corporation, Palm Beach Gardens, FL (US)

(72) Inventors: Paul M. Johnson, Clinton, MA (US); Joseph Albert Senecal, Wellesley, MA (US); David VanZandt, Uxbridge, MA (US); Mohammed Ateeq, Shrewsbury, MA (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/824,254

(22) Filed: May 25, 2022

(65) Prior Publication Data

US 2022/0288436 A1 Sep. 15, 2022

Related U.S. Application Data

(63) Continuation of application No. 16/468,180, filed as application No. PCT/US2017/067641 on Dec. 20, 2017, now Pat. No. 11,376,458.

(60) Provisional application No. 62/436,691, filed on Dec. 20, 2016.

(51) Int. Cl.
*A62C 99/00* (2010.01)
*A62C 37/36* (2006.01)

(52) U.S. Cl.
CPC ..... *A62C 99/0018* (2013.01); *A62C 37/04* (2013.01); *A62C 37/36* (2013.01)

(58) Field of Classification Search
CPC ... A62C 99/0018; A62C 99/0009; A62C 3/08; A62C 35/023; A62C 37/04; A62C 37/36; A62C 37/50
USPC ..... 169/9, 11, 16, 23, 46, 47, 56, 60, 61, 62
See application file for complete search history.

(56) References Cited

U.S. PATENT DOCUMENTS

| | | | |
|---|---|---|---|
| 5,128,881 | A | 7/1992 | Saum et al. |
| 5,857,525 | A | 1/1999 | Okamoto |
| 6,082,464 | A | 7/2000 | Mitchell et al. |
| 6,601,653 | B2 | 8/2003 | Grabow et al. |

(Continued)

FOREIGN PATENT DOCUMENTS

| | | | |
|---|---|---|---|
| CN | 101119772 | A | 2/2008 |
| EP | 1475128 | A1 | 11/2004 |

OTHER PUBLICATIONS

Chinese Office Action for Application No. 201780078692.3; dated Jul. 2, 2020; 9 Pages.

(Continued)

*Primary Examiner* — Steven J Ganey
(74) *Attorney, Agent, or Firm* — Cantor Colburn LLP

(57) ABSTRACT

A fire protection system and method for an enclosure includes an inert agent supply source configured to discharge an inert agent following a discharge of a primary agent in the enclosure, a gas detector configured to determine a gas concentration level in the enclosure, and a controller connected with the inert agent supply source and the gas detector and configured to regulate the discharge of the inert agent into the enclosure based at least partially upon the gas concentration level.

16 Claims, 5 Drawing Sheets

(56) References Cited

U.S. PATENT DOCUMENTS

| | | | | |
|---|---|---|---|---|
| 6,871,802 | B2 | 3/2005 | Stilwell et al. | |
| 6,896,067 | B2 | 5/2005 | Bowyer et al. | |
| 7,509,968 | B2 | 5/2009 | Surawski | |
| 7,861,792 | B2 | 1/2011 | Andersen et al. | |
| 8,079,421 | B2 | 12/2011 | Wagner | |
| 8,256,525 | B2 | 9/2012 | Wagner | |
| 8,360,162 | B2 * | 1/2013 | Lelic | A62C 99/0018 169/37 |
| 8,602,119 | B2 | 12/2013 | Wagner | |
| 8,678,101 | B2 | 3/2014 | Gatsonides et al. | |
| 8,813,858 | B2 | 8/2014 | Gatsonides et al. | |
| 9,033,061 | B2 | 5/2015 | Chattaway et al. | |
| 9,072,921 | B2 | 7/2015 | Ribarov et al. | |
| 9,079,054 | B2 | 7/2015 | Claessen et al. | |
| 9,220,937 | B2 * | 12/2015 | Wagner | A62C 99/0009 |
| 9,387,352 | B2 | 7/2016 | Habitzl | |
| 11,376,458 | B2 * | 7/2022 | Johnson | A62C 37/04 |
| 2002/0070035 | A1 | 6/2002 | Grabow et al. | |
| 2003/0136879 | A1 | 7/2003 | Grabow et al. | |
| 2010/0236796 | A1 | 9/2010 | Chattaway et al. | |
| 2011/0253396 | A1 | 10/2011 | Claessen et al. | |
| 2011/0308823 | A1 | 12/2011 | Seebaluck et al. | |
| 2012/0217028 | A1 | 8/2012 | Chattaway et al. | |
| 2014/0353427 | A1 | 12/2014 | Meckes et al. | |
| 2015/0028122 | A1 | 1/2015 | Kochelek et al. | |
| 2016/0096051 | A1 | 4/2016 | Baker et al. | |
| 2016/0206904 | A1 | 7/2016 | Senecal et al. | |
| 2016/0257419 | A1 | 9/2016 | Artaud et al. | |
| 2016/0332012 | A1 | 11/2016 | Lenkeit et al. | |
| 2019/0329081 | A1 | 10/2019 | Johnson et al. | |

OTHER PUBLICATIONS

International Search Report and Written Opinion for application, dated Mar. 7, 2018, 14 pages.

European Search Report for Application No. 17829523.4; dated Jul. 8, 2022; 8 Pages.

* cited by examiner

FIRE PROTECTION SYSTEM FOR AN ENCLOSURE AND METHOD OF FIRE PROTECTION FOR AN ENCLOSURE

CROSS-REFERENCE TO RELATED APPLICATIONS

This application is a continuation of U.S. patent application Ser. No. 16/468,180, filed Jun. 10, 2019, which is a 371 U.S. National Stage application of PCT/US2017/067641, filed Dec. 20, 2017, which claims the benefit of U.S. Provisional Application No. 62/436,691, filed Dec. 20, 2016, the entire contents of which are incorporated herein by reference.

TECHNICAL FIELD

The presently disclosed embodiments generally relate to fire protection systems and, more particularly, to a system and method fire protection for an enclosure.

BACKGROUND

Gaseous agent total flooding fire protection systems involve the discharge of an extinguishing agent to extinguish a fire and provide protection within the design envelope for a minimum time period, such as a time period sufficient to allow for response by trained personnel, normally referred to as the "hold time." The fire-extinguishing atmosphere is maintained in order to prevent re-ignition during the hold time. However, the concentration of extinguishing agent reduces over time due to leakage from the enclosure and the introduction of air from outside of the enclosure. In order to maintain the fire-extinguishing atmosphere, some fire protection applications require an extended period of fire protection within an enclosure beyond the initial hold time. Some systems introduce a secondary supply of extinguishing agent into the enclosure in an effort to compensate for agent lost through leakage and to maintain agent concentration throughout the enclosure at or above a minimum required level for the length of time required.

However, such systems may not be effective due to inadequate turbulence in the room to mix the gases and/or a reduced discharge rate as the supply becomes depleted could fall below the enclosure's leakage rate, thereby leading to a relatively unpredictable atmosphere within the enclosure. Further, the agent concentration may fall below the minimum required level without indication or warning.

Therefore, there exists a need in the art for a fire protection system and method that effectively and automatically maintains a fire-extinguishing atmosphere within an enclosure.

SUMMARY

In accordance with an embodiment of the present disclosure, a fire protection system for an enclosure is provided. The fire protection system includes an inert agent supply source configured to discharge an inert agent following a discharge of a primary agent in the enclosure, a gas detector configured to determine a gas concentration level in the enclosure, and a controller connected with the inert agent supply source and the gas detector and configured to regulate the discharge of the inert agent into the enclosure based at least partially upon the gas concentration level.

The system may further include a primary agent supply source configured to discharge the primary agent in the enclosure. The gas detector may be an oxygen level detector configured to determine an oxygen concentration level in the enclosure. The controller may be configured to initiate discharge of the inert agent when the oxygen concentration level exceeds a predetermined oxygen concentration level threshold. The predetermined oxygen concentration level threshold may be between 4% and 20%. The controller may be configured to regulate the discharge of the inert agent for a predetermined hold time. The inert agent may include nitrogen. A second gas detector may be configured to detect the presence of a flammable gas in the enclosure. The inert agent supply source may include at least one discharge valve. The system may further include a release unit configured to receive a release signal from the controller and apply pressure to the at least one discharge valve upon discharge of the inert agent.

In accordance with an embodiment of the present disclosure, a method of fire protection for an enclosure is provided. The method includes discharging a primary agent in the enclosure, determining a gas concentration level in the enclosure, and discharging an inert agent in the enclosure upon a determination that the gas concentration level is greater than a predetermined gas concentration threshold.

The primary agent may be discharged with a primary agent supply source, and the inert agent may be discharged with an inert agent supply source. The inert agent supply source may include at least one discharge valve. The method may further include sending a signal to a release unit and pressurizing the discharge valve to discharge the inert agent. Determining the gas concentration level may include determining an oxygen concentration level in the enclosure. Discharging the inert agent in the enclosure may occur upon a determination that the oxygen concentration level is greater than a predetermined oxygen concentration threshold. The predetermined oxygen concentration threshold may be between 4% and 20%. The method may further include regulating the discharge of the inert agent in the enclosure for a predetermined hold time. The inert agent may include nitrogen. The method may include detecting the presence of a flammable gas in the enclosure.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION

Figure 1:
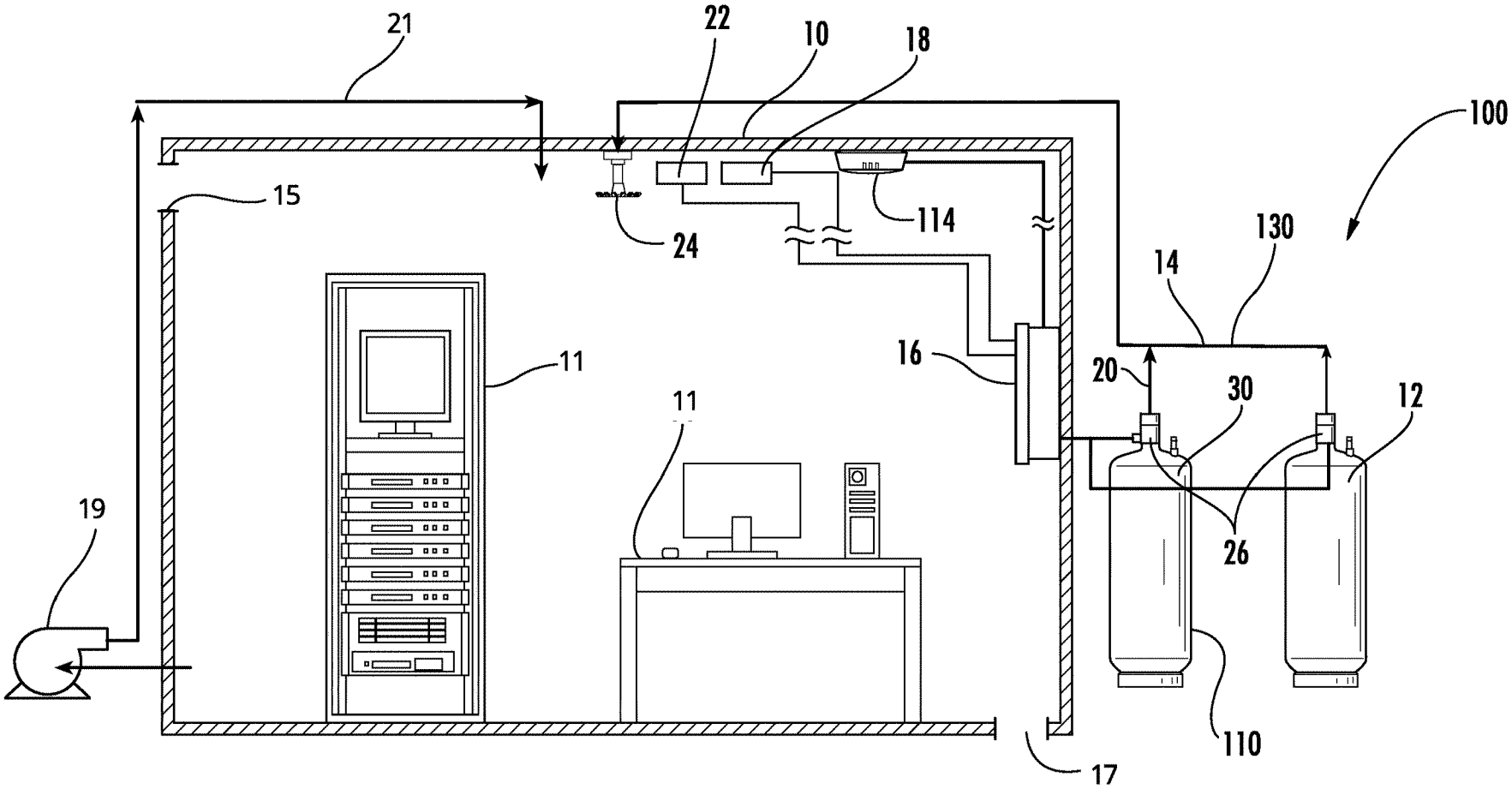
FIG. 1 is a schematic diagram of a fire protection system in accordance with an embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Referring now to FIG. 1, a schematic representation of an enclosure 10 protected by a fire protection system 100 constructed in accordance with an embodiment of the present disclosure is illustrated. As illustrated, the enclosure 10 of an embodiment includes leakage openings, including, for example, an upper leakage opening 15 and a lower leakage opening 17. Those skilled in the art will readily appreciate that a leakage opening in such an enclosure could take the form of a vent or duct or an unsealed opening associated with a door or window. The enclosure 10 also includes a HVAC blower 19 for circulating air throughout the enclosure 10 by way of a ventilation system 21.

In accordance with applicable NFPA codes and regulations (i.e., Annex C of NFPA 2001 and Annex E of ISO 14520 a), the enclosure 10 has a defined hold-time, which is the period of time required for agent concentration to drop to (or below) a specified level. For example, the hold-time for a given enclosure could be equal to 10 minutes, providing ample time for fire fighters to arrive. The controller 16 is configured to regulate the discharge of the inert agent 14 for the predetermined hold time. The predetermined hold time may be between 5 and 30 minutes in an embodiment and between 8 and 12 minutes in another embodiment.

The fire protection system 100 of an embodiment includes an inert agent supply source 12 configured to discharge an inert agent 14 in the enclosure 10. The inert agent 14 includes nitrogen in an embodiment. The inert agent 14 includes argon in an embodiment. In one or more embodiments, inert agent 14 is any inert gas agent containing nitrogen, argon, carbon dioxide, and/or any mixture that includes one or more of these gases. In an embodiment, the fire protection system 100 includes a primary agent supply source 30 configured to discharge a primary agent 20 in the enclosure 10. The primary agent 20 of one or more embodiments is selected from a variety of commercially available gaseous agents having a wide range of properties including, to name non-limiting examples, HFC-227e, HFC-125, FK-5-1-12 and IG-541. Other known fire suppression agents can be employed without departing from the scope of the subject disclosure.

The primary agent supply source 30 includes or is connected to a piping system 130. In an embodiment, the inert agent supply source 12 also includes or is connected to the piping system 130. The piping system 130 terminates at or is otherwise connected to one or more discharge valves 24. The discharge valve 24 is a balanced piston valve in an embodiment. In an embodiment not illustrated, the inert agent supply source 12 includes or is connected to a piping system and/or discharge valve(s) 24 that is/are separate from the piping system 130.

Each of the inert agent supply source 12 and the primary agent supply source 30 can take the form of a single agent supply reservoir or vessel, as shown in FIG. 1. Alternatively, each of the inert agent supply source 12 and the primary agent supply source 30 may include multiple agent supply reservoirs. These agent supply reservoirs could be connected to a manifold so that gaseous agent can be distributed to nozzles at multiple locations within the protected enclosure by way of the piping system 130 associated with the manifold.

The fire protection system 100 further includes a controller 16 connected to or otherwise in communication with the inert agent supply source 12 and, in an embodiment, the primary agent supply source 30. In an embodiment, the controller 16 is configured to discharge an inert agent 14 from the inert agent supply source 12 following, in an embodiment, a discharge of the primary agent 20 in the enclosure 10. The controller 16 is also connected to or otherwise in communication with a gas detector 18. The gas detector 18 is configured to determine a gas concentration level in the enclosure 10. The gas detector 18 in an embodiment is an oxygen level detector configured to determine an oxygen concentration level in the enclosure 10. The oxygen level detector of an embodiment is an oxygen sensor. One of ordinary skill in the art will recognize the various components and processes that may be used to determine a gas or oxygen level within the enclosure 10, and such components and processes form part of the present disclosure.

The controller 16 is configured to regulate the discharge of the inert agent 14 into the enclosure 10 based at least partially upon the gas concentration level. In an embodiment, the controller 16 is configured to initiate discharge of the inert agent 14 when the oxygen concentration level exceeds a predetermined oxygen concentration threshold. The predetermined oxygen concentration level threshold is between 4% and 20% in an embodiment, between 10% and 20% in an embodiment, and between 13% and 15% in another embodiment.

In an embodiment, the controller 16 includes a second gas detector 22 configured to detect the presence of a flammable gas in the enclosure 10. In such an embodiment, the second gas detector 22 is configured to analyze detectable flammable gas in the enclosure and send such information to the controller 16.

The fire protection system 100 further includes a release unit 26. The controller 16 transmits a release signal to the release unit 26 to initiate discharge of the inert agent 14. In an embodiment, the release signal is a 24 volt signal. The release unit 26, upon receiving the release signal, sends pneumatic pressure to the one or more discharge valve(s) 24. The discharge valve(s) 24 discharge the inert agent 14 upon receiving the pneumatic pressure from the release unit 26. The discharge valve(s) includes one or more balanced piston valve(s) configured to release the inert agent 14 upon receiving at least 8 bar pneumatic pressure in an embodiment.

The controller 16 may regulate or otherwise control the discharge of the inert agent 14 and/or the primary agent 20 through the piping system 30 and/or the discharge valve(s) 24 in response to a signal received from a smoke detector 114, the gas detector 18, the second gas detector 22, and/or another local or remote signal source. Any of these links or connections may be wireless or hard-wired.

Figure 3:
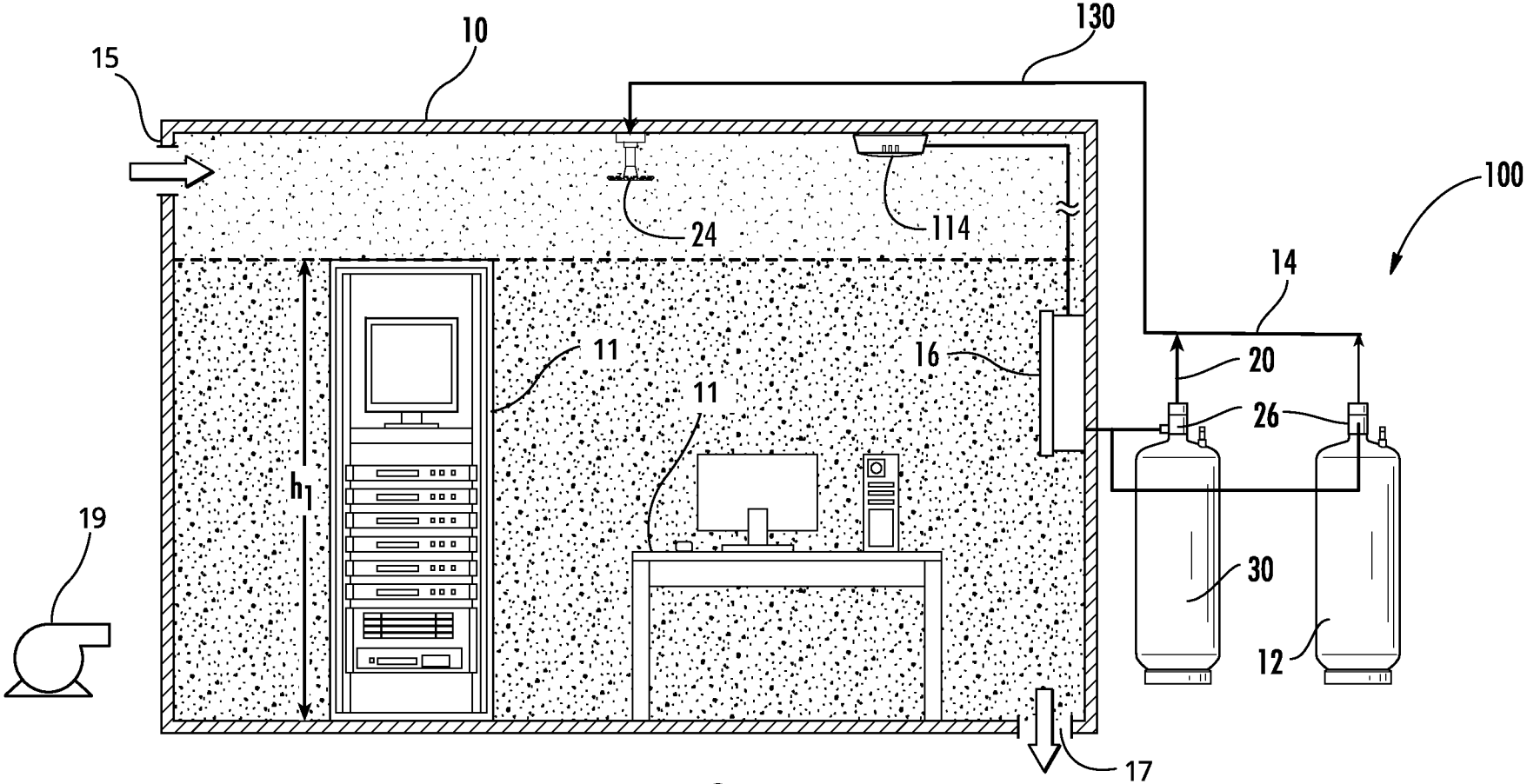
FIG. 3 is a schematic diagram of a fire protection system in accordance with an embodiment of the present disclosure.
Figure 4:
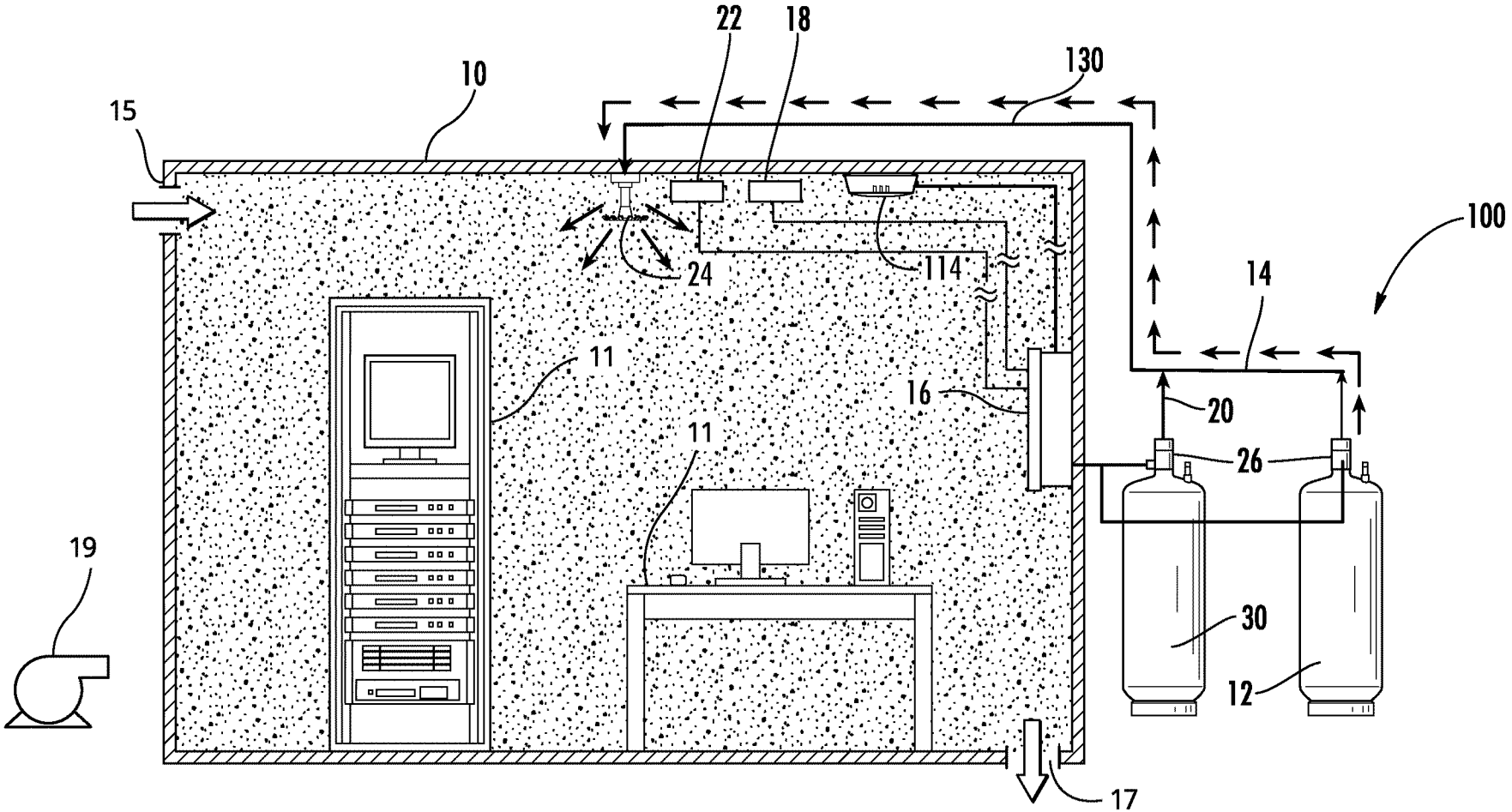
FIG. 4 is a schematic diagram of a fire protection system in accordance with an embodiment of the present disclosure.
Figure 5:
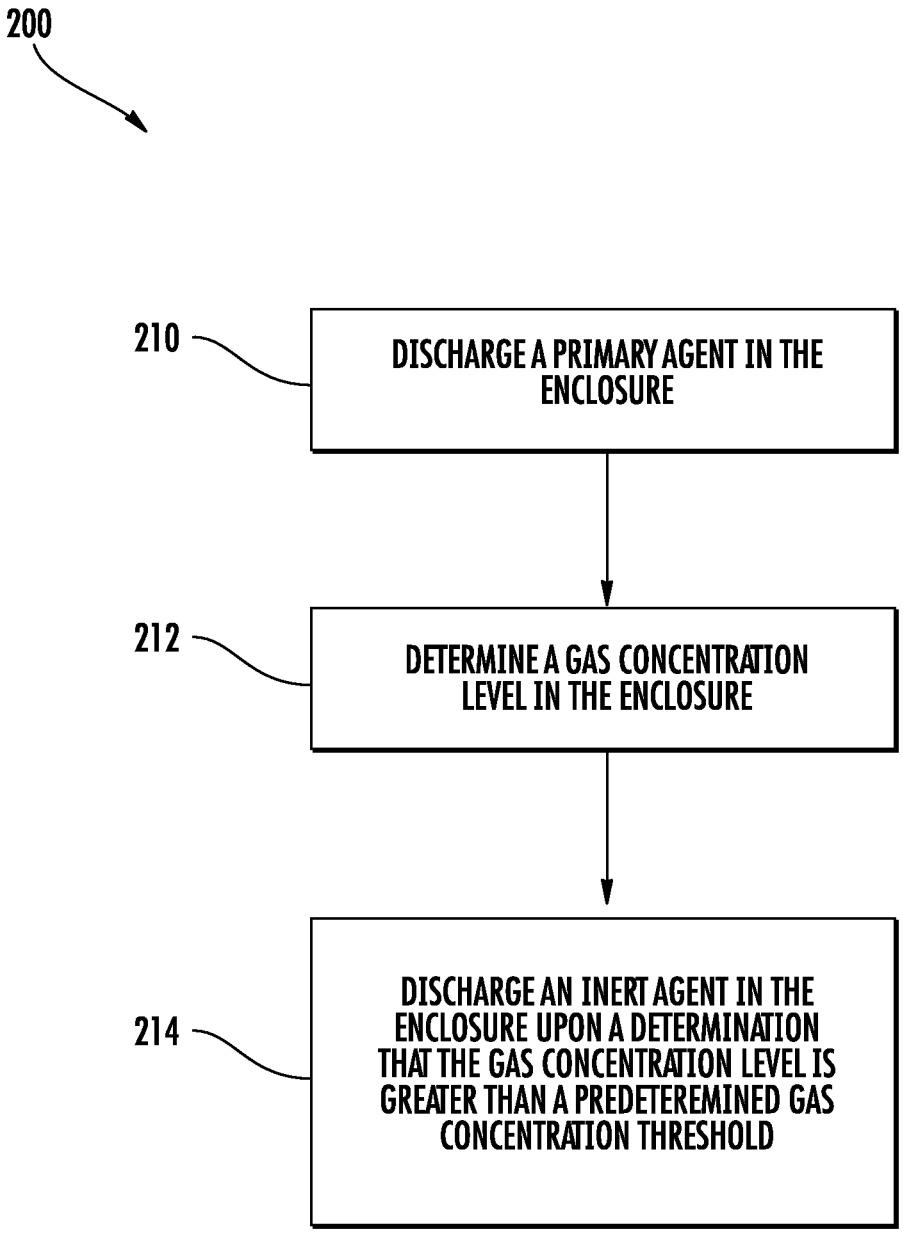
FIG. 5 illustrates a method of fire protection in accordance with an embodiment of the present disclosure.

Referring now to FIG. 5 with continuing reference to FIGS. 1-4, a method 200 of fire protection for an enclosure 10 is provided. With reference to FIG. 1, the primary agent supply source 30 contains an initial amount of a gaseous agent sufficient to achieve a predetermined initial concentration level of gaseous agent in the enclosure 10 for the hold time. The inert agent supply source 12 contains an amount of inert agent 14 sufficient to restore the concentration of gaseous agent in the enclosure 10 to the predetermined initial level, and thereby extend fire protection for the enclosure 10 for a period beyond the enclosure's hold time. The controller 16 may be adapted and configured to detect a real-time change in the leakage characteristics of the enclosure 10 (e.g., detecting an open window sensor) warranting a change in the discharge profile for inert agent supply source 12, particularly in the upper boundaries of the enclosure.

Figure 2:
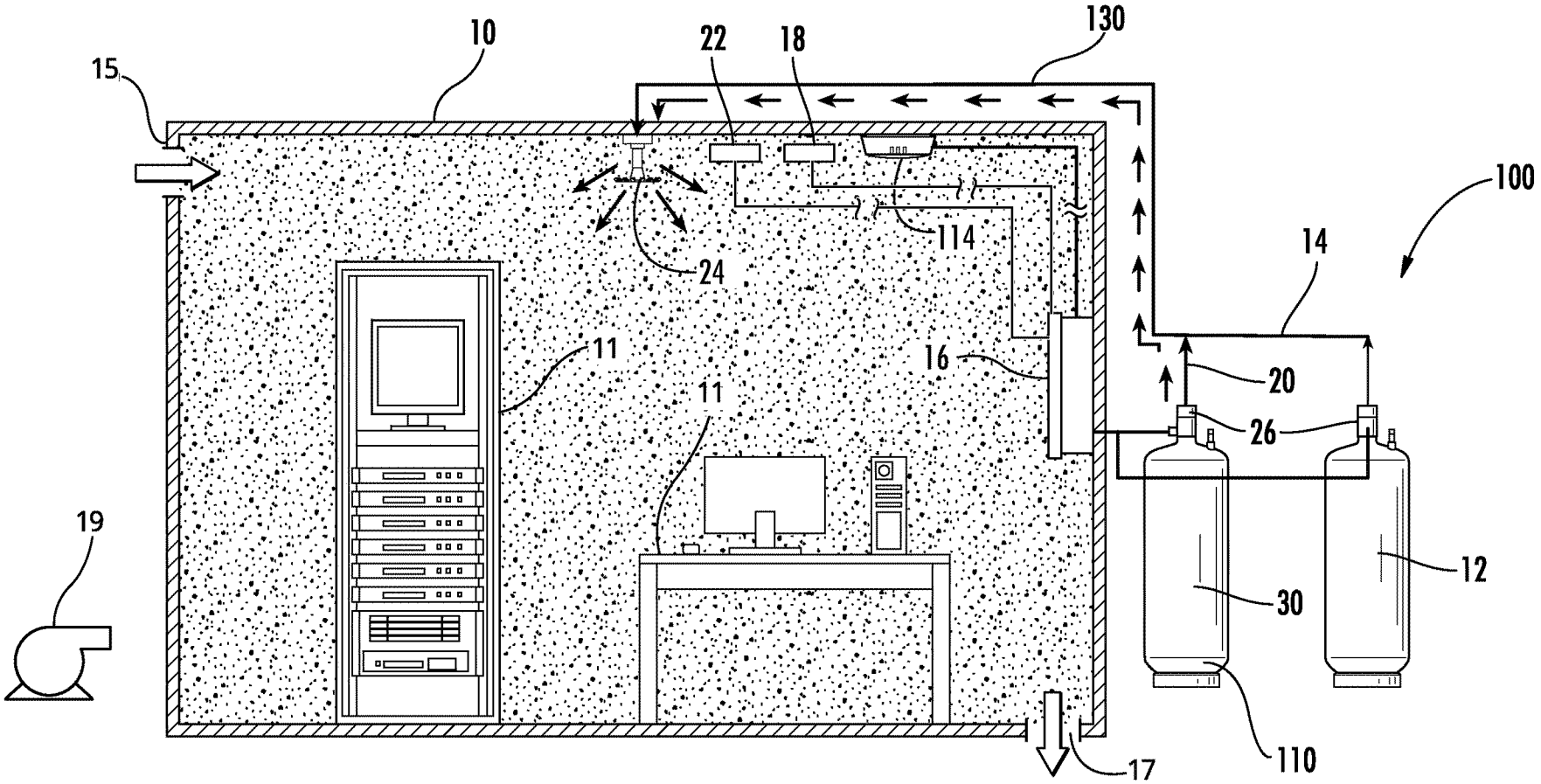
FIG. 2 is a schematic diagram of a fire protection system in accordance with an embodiment of the present disclosure.

The method 200 of FIG. 5 includes the step of discharging, at step 210, the primary agent 20 in the enclosure 10. Referring to FIG. 2, when the primary agent supply source 30 of fire protection system 100 discharges an amount of the primary agent 20 into the enclosure 10, there is a sufficient amount of gaseous agent in the enclosure to achieve a predetermined initial concentration level of 100% of the MDC of the enclosure 10. After this initial discharge, a relatively uniform mixture of agent and air remains inside the enclosure 10 for a period of time, preferably equal to the enclosure's rated hold time. However, the density of the agent/air mixture in the enclosure 10 is greater than the density of the air surrounding the enclosure 10. This difference exerts a positive hydrostatic pressure at the lower boundaries of the enclosure 10, forcing the air/agent mixture to egress from the enclosure 10 through the available lower leakage opening 17. This leakage creates a negative pressure differential at the upper boundaries of the enclosure 10. Since the volume of the enclosure 10 is fixed, as primary agent 20 leaks out of the lower leakage opening 17, an equal amount of air from outside the enclosure ingresses into the upper leakage opening 15. Consequently, the concentration of primary agent 20 within the enclosure 10 decreases over time.

More particularly, as shown in FIG. 3, a particular time period lapses after the primary agent 20 is discharged. The concentration of primary agent 20 has decreased in the upper part of the enclosure 10. By way of non-limiting example, the concentration of primary agent 20 in the enclosure 10 has decreased to about 85% of the MDC at a height h1 of the enclosure, which is the height of a protected asset 11.

The method 200 of FIG. 5 includes the step of determining, at step 212, a gas concentration level in the enclosure 10, such as an oxygen concentration level in one embodiment. In the embodiment illustrated in FIG. 3, the gas or oxygen concentration level is below the predetermined gas or oxygen concentration threshold. Thereupon, under the applicable fire protection standards, the protective atmosphere within enclosure 10 is deemed deficient. This requires remedial action to restore the concentration of gaseous agent to the initial predetermined level.

The method 200 of FIG. 5 further includes the step of discharging, at step 214, the inert agent 14 in the enclosure 10 upon a determination that the gas concentration level is greater than the predetermined gas concentration threshold. FIG. 4 is an illustration of the protected enclosure 10 when the inert agent supply source 12 discharges inert agent 14 into the enclosure 10 sufficient to restore the concentration of gaseous agent in the enclosure 10 to the predetermined initial level of 100% of the MDC.

The fire protection system 100 and method 200 of the embodiments disclosed herein provide an automated means of detecting and/or determining a current state of a fire extinguishing atmosphere within the enclosure 10. Further, the fire protection system 100 and method 200 provide the ability to automatically increase or supplement an agent concentration level in order to prevent ignition.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. A fire protection system for an enclosure, comprising:
an inert agent supply source configured to discharge an inert agent following a discharge of a primary agent in the enclosure;
a gas detector configured to determine a gas concentration level in the enclosure; and
a controller connected with the inert agent supply source and the gas detector and configured to regulate the discharge of the inert agent into the enclosure based at least partially upon the gas concentration level;
wherein the gas detector is an oxygen level detector configured to determine an oxygen concentration level in the enclosure;
wherein the controller is configured to initiate discharge of the inert agent when the oxygen concentration level exceeds a predetermined oxygen concentration level threshold.

2. The system of claim 1, further comprising a primary agent supply source configured to discharge the primary agent in the enclosure.

3. The system of claim 1, wherein the predetermined oxygen concentration level threshold is between 4% and 20%.

4. The system of claim 1, wherein the controller is configured to regulate the discharge of the inert agent for a predetermined hold time.

5. The system of claim 1, wherein the inert agent comprises nitrogen.

6. The system of claim 1, further comprising a second gas detector configured to detect the presence of a flammable gas in the enclosure.

7. The system of claim 1, wherein the inert agent supply source includes at least one discharge valve.

8. The system of claim 7, further comprising a release unit configured to receive a release signal from the controller and apply pressure to the at least one discharge valve upon discharge of the inert agent.

9. A method of fire protection for an enclosure, the method comprising:
discharging a primary agent in the enclosure;
determining a gas concentration level in the enclosure; and
discharging an inert agent in the enclosure upon a determination that the gas concentration level is greater than a predetermined gas concentration threshold;
wherein determining the gas concentration level includes determining an oxygen concentration level in the enclosure;
wherein discharging the inert agent in the enclosure occurs upon a determination that the oxygen concentration level is greater than a predetermined oxygen concentration threshold.

10. The method of claim 9, wherein the primary agent is discharged with a primary agent supply source and the inert agent is discharged with an inert agent supply source.

11. The method of claim 10, wherein the inert agent supply source includes at least one discharge valve.

12. The method of claim 11, further comprising:
sending a signal to a release unit; and
pressurizing the discharge valve to discharge the inert agent.

13. The method of claim 9, wherein the predetermined oxygen concentration threshold is between 4% and 20%.

14. The method of claim 9, further comprising regulating the discharge of the inert agent in the enclosure for a predetermined hold time.

15. The method of claim 9, wherein the inert agent comprises nitrogen.

16. The method of claim 9, further comprising detecting the presence of a flammable gas in the enclosure.

* * * * *